US009010536B2

(12) United States Patent
McCanless et al.

(10) Patent No.: US 9,010,536 B2
(45) Date of Patent: Apr. 21, 2015

(54) NESTABLE CAN TRAY

(71) Applicant: Rehrig Pacific Company, Los Angeles, CA (US)

(72) Inventors: Margaret McCanless, Lawrenceville, GA (US); William P Apps, Alpharetta, GA (US); Kyle L. Baltz, Rossmoor, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/097,951

(22) Filed: Dec. 5, 2013

(65) Prior Publication Data

US 2014/0158576 A1 Jun. 12, 2014

Related U.S. Application Data

(60) Provisional application No. 61/734,259, filed on Dec. 6, 2012.

(51) Int. Cl.

| | |
|---|---|
| ***B65D 90/12*** | (2006.01) |
| ***B65D 1/36*** | (2006.01) |
| ***B65D 25/04*** | (2006.01) |
| ***B65D 57/00*** | (2006.01) |
| ***B65D 85/20*** | (2006.01) |
| ***B65D 85/72*** | (2006.01) |
| ***B65D 21/02*** | (2006.01) |
| ***B65D 71/70*** | (2006.01) |

(52) U.S. Cl.
CPC ..... *B65D 21/0233* (2013.01); *B65D 71/70* (2013.01)

(58) Field of Classification Search
USPC ..... 220/607, 608, 626, 628, 635, 606, 215, 220/515, 516; 206/557–567, 503–513, 206/515–520
See application file for complete search history.

(56) References Cited

U.S. PATENT DOCUMENTS

| | | | | |
|---|---|---|---|---|
| 4,846,365 | A * | 7/1989 | Steinlein | 220/516 |
| 5,009,053 | A * | 4/1991 | Langenbeck et al. | 53/58 |
| 7,658,278 | B2 * | 2/2010 | Apps et al. | 206/203 |
| 2002/0148837 | A1 * | 10/2002 | Apps | 220/515 |
| 2005/0279651 | A1 * | 12/2005 | Perret et al. | 206/203 |

* cited by examiner

*Primary Examiner* — Jeffrey Allen
*Assistant Examiner* — Jennifer Castriotta
(74) *Attorney, Agent, or Firm* — Carlson, Gaskey & Olds

(57) ABSTRACT

A nestable can tray includes a base including a plurality of intersecting vertical rib portions. A plurality of horizontal wall portions are connected proximate lower ends of the vertical rib portions. A plurality of annular recesses are formed on an upper surface of the base for receiving lower ends of beverage cans. The tray further includes side walls including side columns extending upward from lower side wall portions at sides of the base. End walls include end columns at ends of the base. The side columns are configured to be partially receivable into side columns of an identical tray nested thereon and the end columns are configured to be partially receivable into end columns of the identical tray nested thereon.

20 Claims, 12 Drawing Sheets

NESTABLE CAN TRAY

BACKGROUND

Plastic nestable can trays are used for shipping and merchandising beverage cans. Beverage cans typically include a cylindrical body portion, an upper ring and a lower ring. The upper ring and the lower ring are susceptible to damage, because contact with the can may be concentrated on the relatively narrow upper and lower rings.

SUMMARY

A nestable can tray includes a base including a plurality of intersecting vertical rib portions. A plurality of horizontal wall portions are connected proximate lower ends of the vertical rib portions. A plurality of annular recesses are formed on an upper surface of the base for receiving lower ends of beverage cans.

The tray further includes side walls including side columns extending upward from lower side wall portions at sides of the base. End walls include end columns at ends of the base. The side columns are configured to be partially receivable into side columns of an identical tray nested thereon and the end columns are configured to be partially receivable into end columns of the identical tray nested thereon.

The end walls may each include a handle extending between two of the end columns. The base may not extend below the handles.

The plurality of vertical rib portions in the base may include a plurality of outer annular ribs each defining one of the annular recesses. The plurality of vertical rib portions in the base may include a plurality of inner annular ribs eccentrically positioned within each of the outer annular ribs. The plurality of vertical rib portions in the base may further include a plurality of radial ribs connecting each inner annular rib to one of the outer annular ribs. The plurality of horizontal wall portions may connect the plurality of inner annular ribs to the plurality of radial ribs. The plurality of horizontal wall portions may be recessed relative to lower ends of the plurality of vertical rib portions.

The nestable can tray may be loaded with a plurality of beverage cans. Each of the beverage cans may include an upper ring and a lower ring. Each lower ring may be received in one of the annular recesses in the base of the tray.

The nestable can tray may be stacked on a plurality of beverage cans therebelow. Each upper ring may contact at least one of the horizontal wall portions in the base of the tray to prevent damage to the upper rings of the cans.

The nestable can tray may be stacked on an identical lower can tray having a plurality of beverage cans loaded therein. Each upper ring of the cans may contact at least one of the horizontal wall portions in the base of the tray. The two trays may be cross-stacked.

DETAILED DESCRIPTION OF A PREFERRED EMBODIMENT

Figure 1:
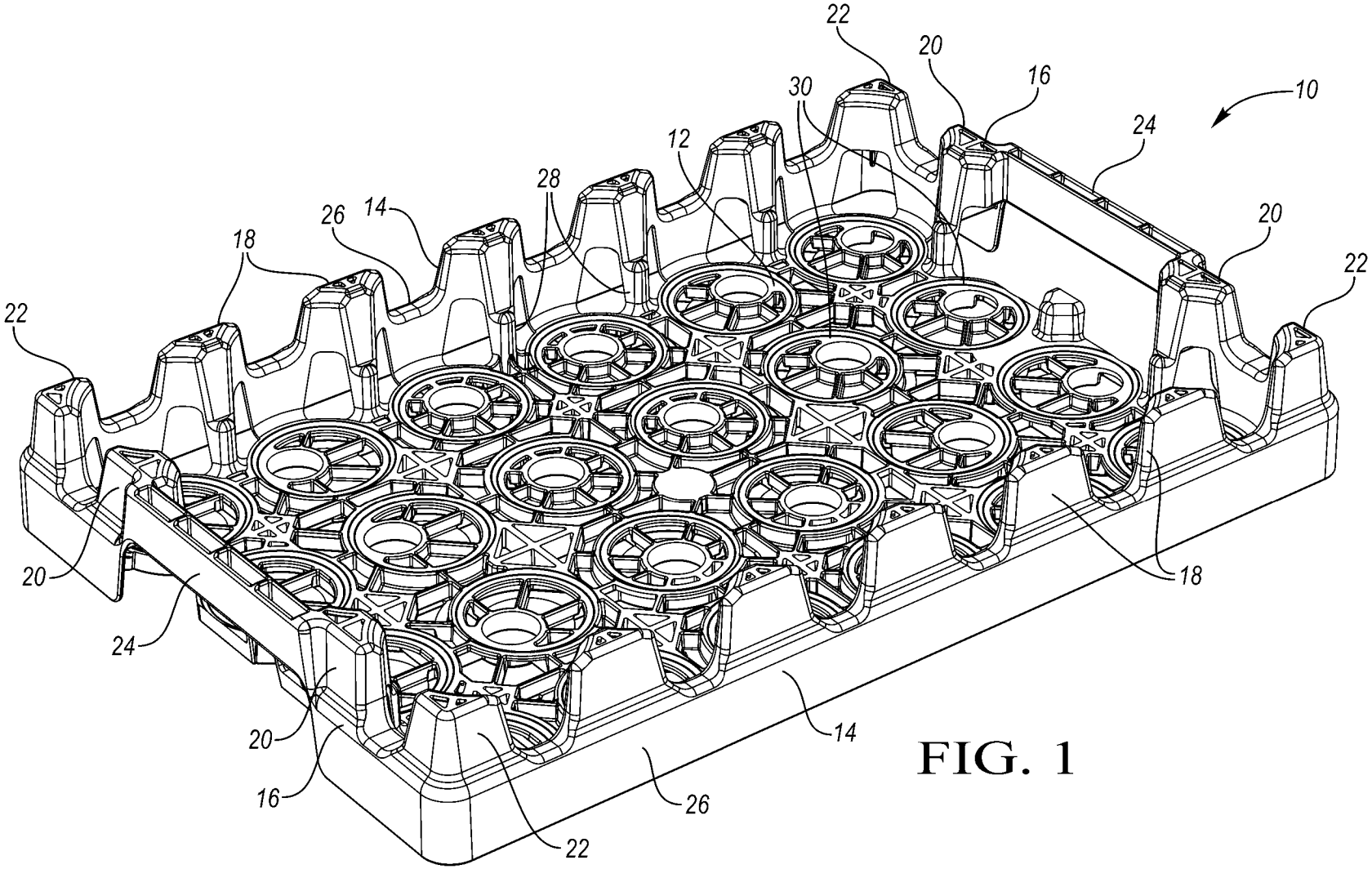
FIG. 1 is a perspective view of a nestable can tray according to one embodiment of the present invention.

A tray 10 according to one embodiment is shown in FIG. 1. The tray 10 includes a base 12, side walls 14 and end walls 16. The side walls 14 may include side columns 18 extending upward from lower wall portions 26. The end walls 16 may include end columns 20. Corner columns 22 may project upward at corners of the tray 10. A divider 28 projects toward an interior of the tray 10 below each side column 18 and end column 20. The dividers 28 partially define can-receiving areas 30 on the base 12.

Figure 2:
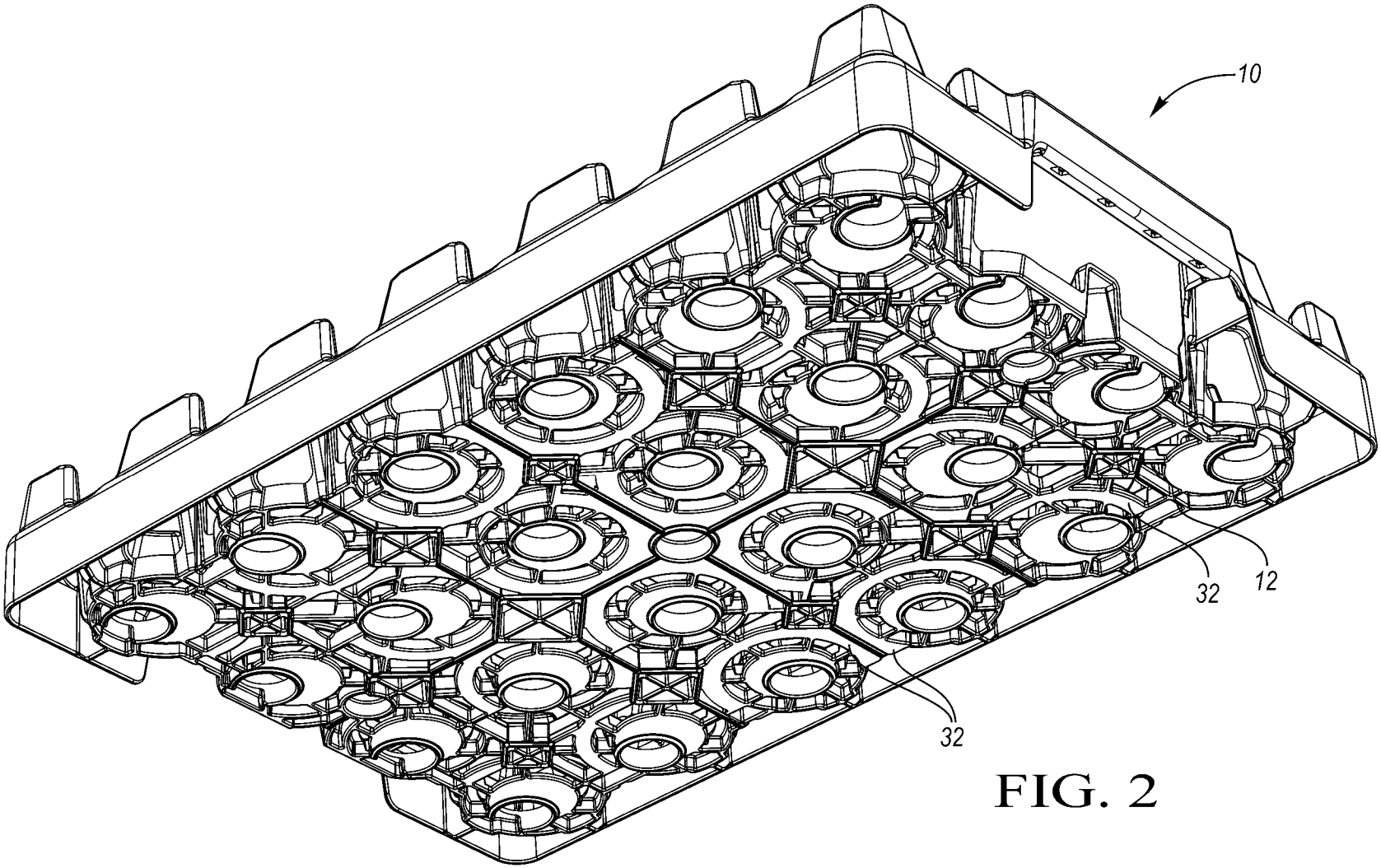
FIG. 2 is a bottom perspective view of the tray of FIG. 1.

FIG. 2 is a bottom perspective view of the tray 10. As shown, the lower surface of the base 12 includes a plurality of horizontal wall portions include horizontal walls 32 for contacting the upper rings of cans stacked therebelow. The horizontal walls 32 are generally arcuate.

Figure 3:
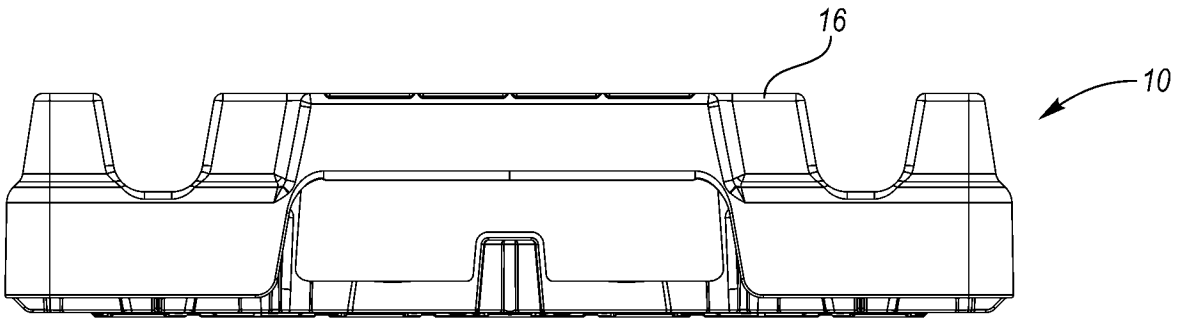
FIG. 3 is an end view of the tray.
Figure 4:
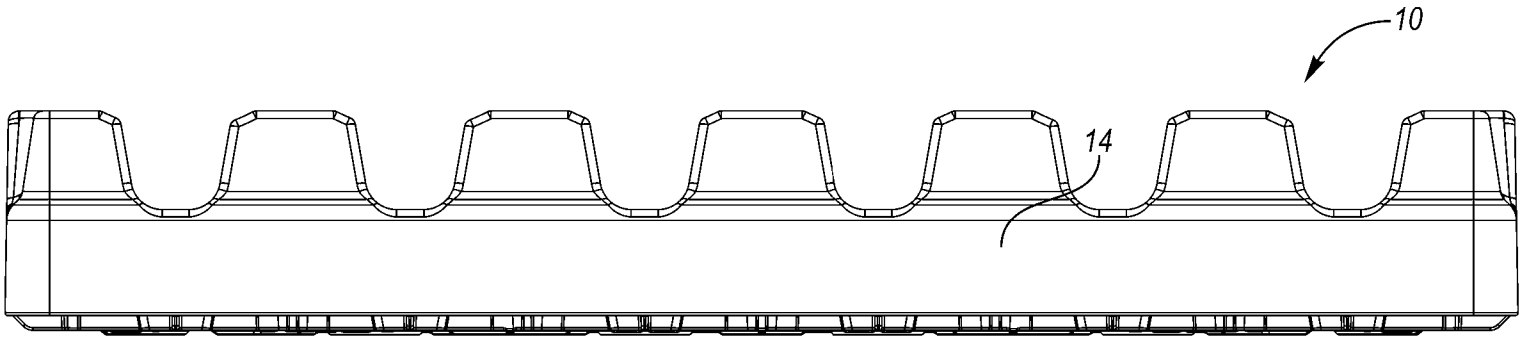
FIG. 4 is a side view of the tray.

FIG. 3 is an end view of the tray 10. FIG. 4 is a side view of the tray 10.

Figure 5:
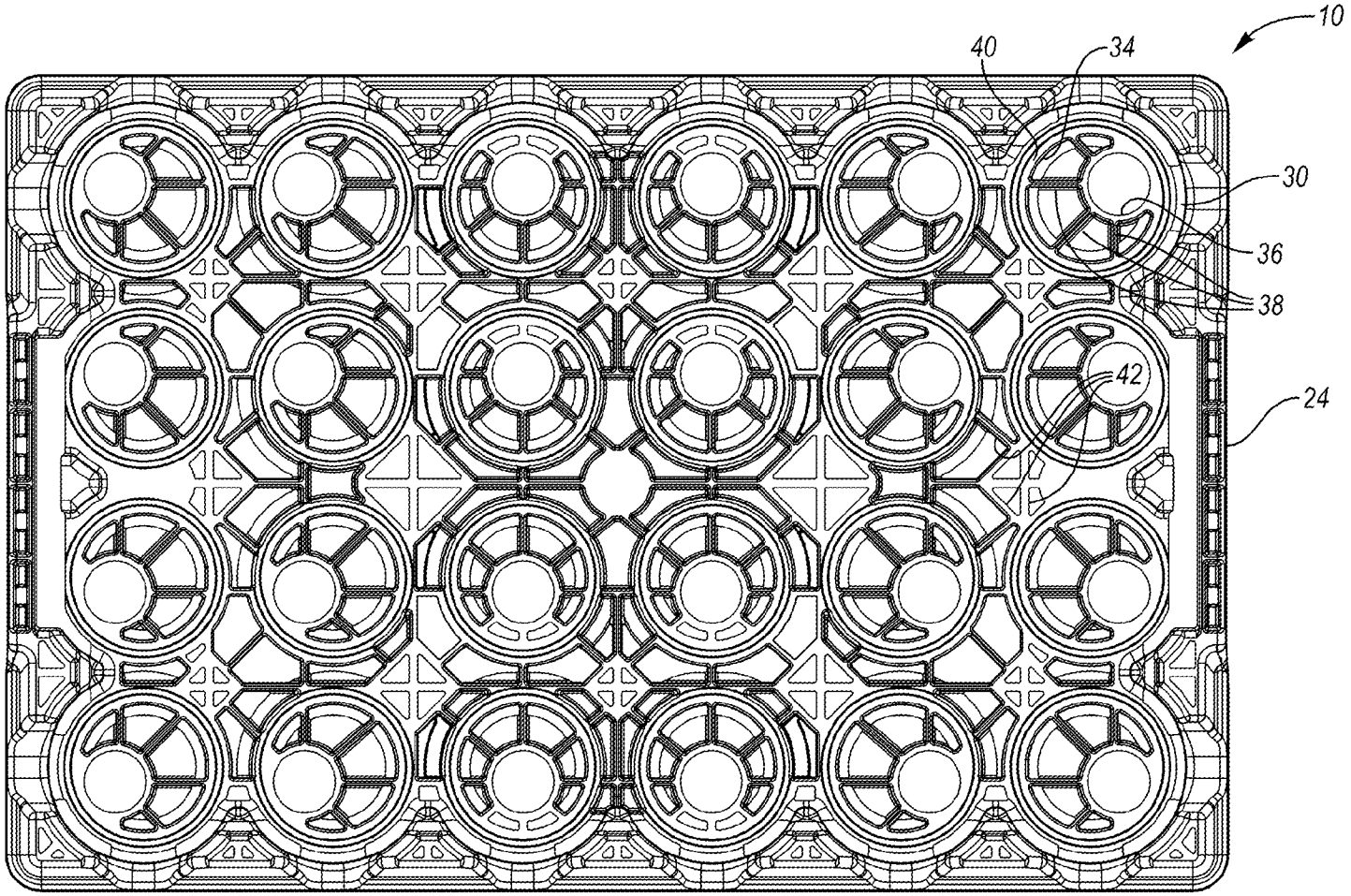
FIG. 5 is a top view of the tray.

FIG. 5 is a top view of the tray 10. The base includes a plurality of can-receiving areas 30. Each can receiving area 30 may include a lower ring support surface 34, which may be a completely annular surface for supporting the entire lower ring of a can. The lower ring support surface 34 is recessed relative to an adjacent raised surface 40 and forms an annular recess within an outer annular rib. An eccentrically positioned inner annular rib 36 is circumscribed by the lower ring support surface 34. A plurality of ribs 38 extend radially from the inner annular rib 36 to the outer annular rib and the lower ring support surface 34. A plurality of ribs 42 in a lattice connect the various components in the base 12.

Figure 6:
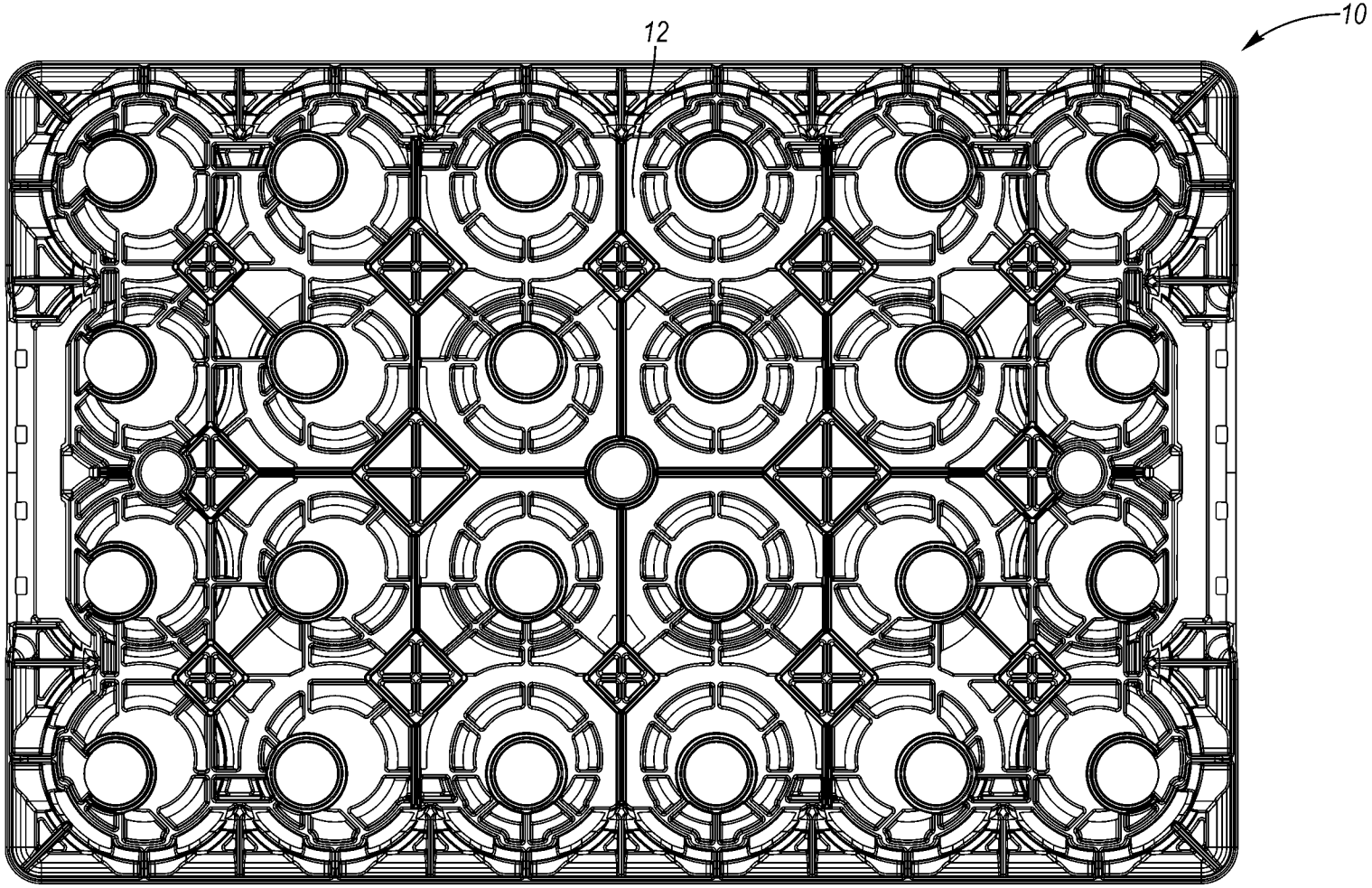
FIG. 6 is a bottom view of the tray.
Figure 7:
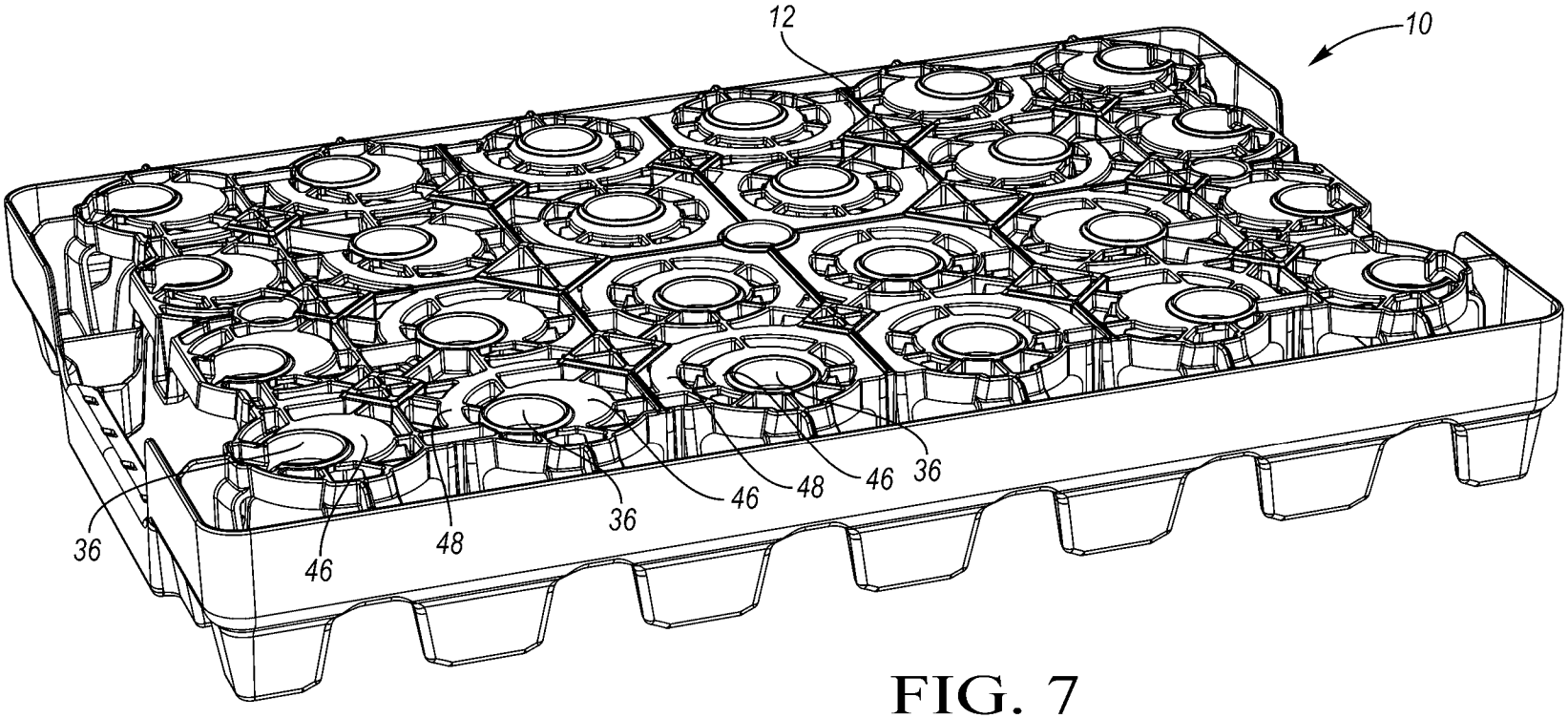
FIG. 7 is a bottom perspective of the tray.

FIGS. 6 and 7 illustrate the bottom surface of the tray 10. Referring to FIG. 7, the bottom surface of the base 12 may include a plurality of horizontal surfaces, including horizontal walls 46 adjacent the annular ribs 36 and below the radial ribs 38 (FIG. 5) and including horizontal wall portions 48 spaced radially outward away from the horizontal walls 46 (below the lower ring support surface 34). The lower surface of the tray 10 provides increased surface contact with the upper rings 102 of the cans 100 in a plurality of different positions and orientations. Concentrating the stress on a single point of the upper ring 102 is avoided. This prevents damage to the upper ring 102 of the can 100 and to the tray 100.

Figure 10:
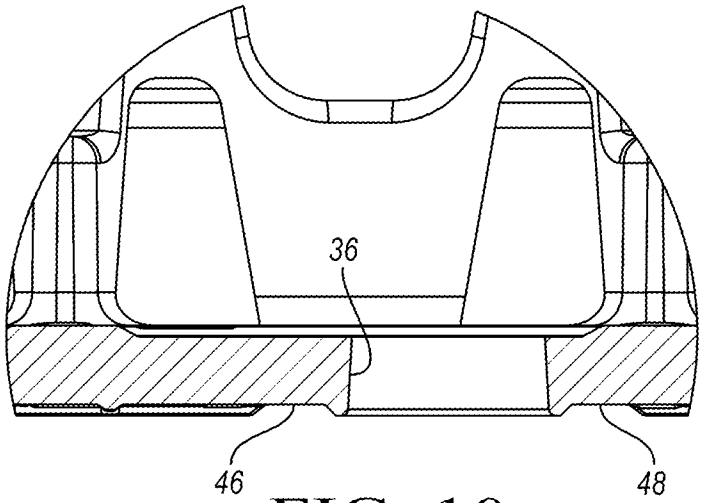
FIG. 10 is an enlarged view of area 10 of FIG. 8.
Figure 9:
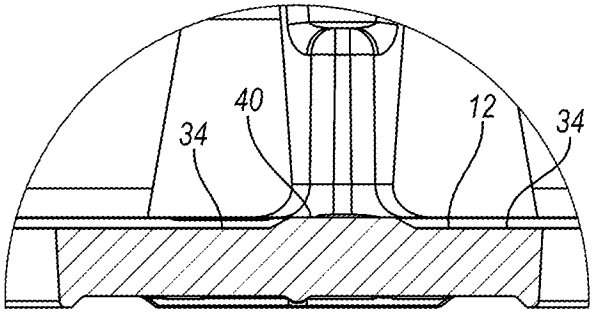
FIG. 9 is an enlarged view of area 9 of FIG. 8
Figure 8:
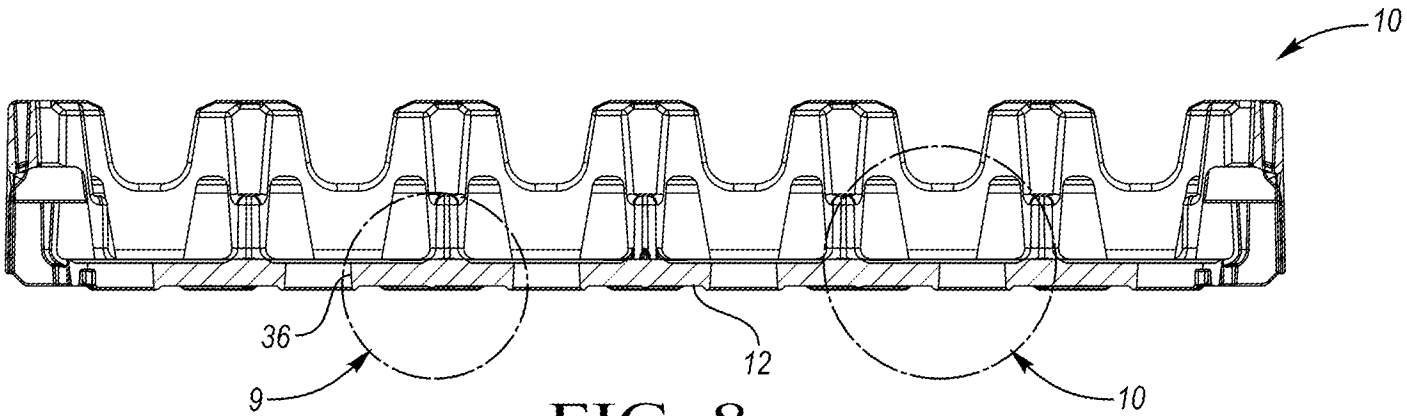
FIG. 8 is a section view of the tray.

FIG. 8 is a section view through the tray 10. FIGS. 9 and 10 are enlarged views of areas 9 and 10, respectively, of the tray 10 of FIG. 8. As shown, increased contact area with the lower ring 104 and the upper ring 102 of the can is provided. The horizontal wall portions 46, 48 are slightly recessed relative to the vertical ribs 36, 38 of the base 12.

Figure 11:
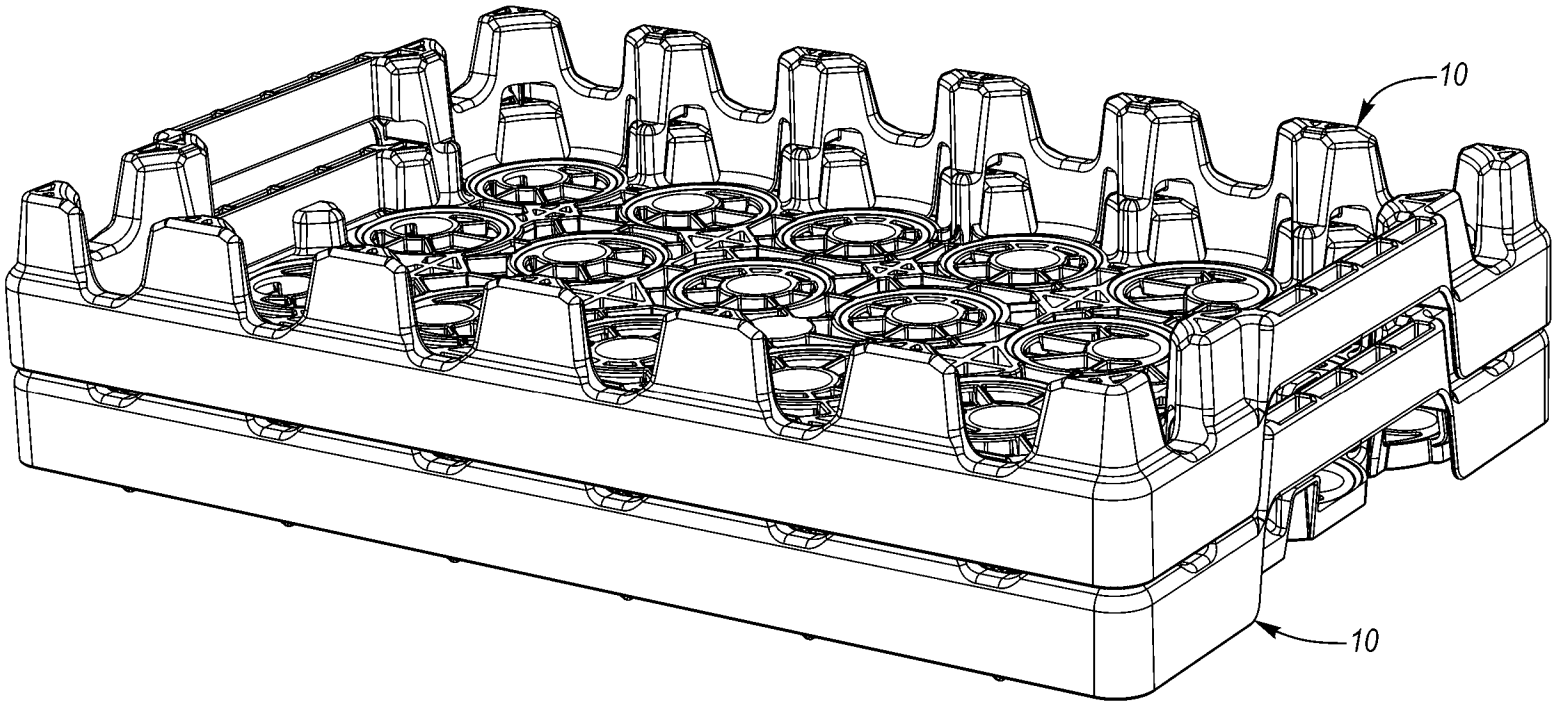
FIG. 11 is a perspective view of the tray nested with an identical tray.

As is shown in FIG. 11, the tray 10 can be nested with an identical tray 10 when empty. The columns 18, 20, 22 of the lower tray 10 are partially received within the columns 18, 20, 22 of the upper tray 10. The handle 24 of the lower tray 10 is received within the recess in the end wall 16 of the upper tray 10 below the handle 24. The bases 12 of the trays 10 are parallel to one another.

Figure 12:
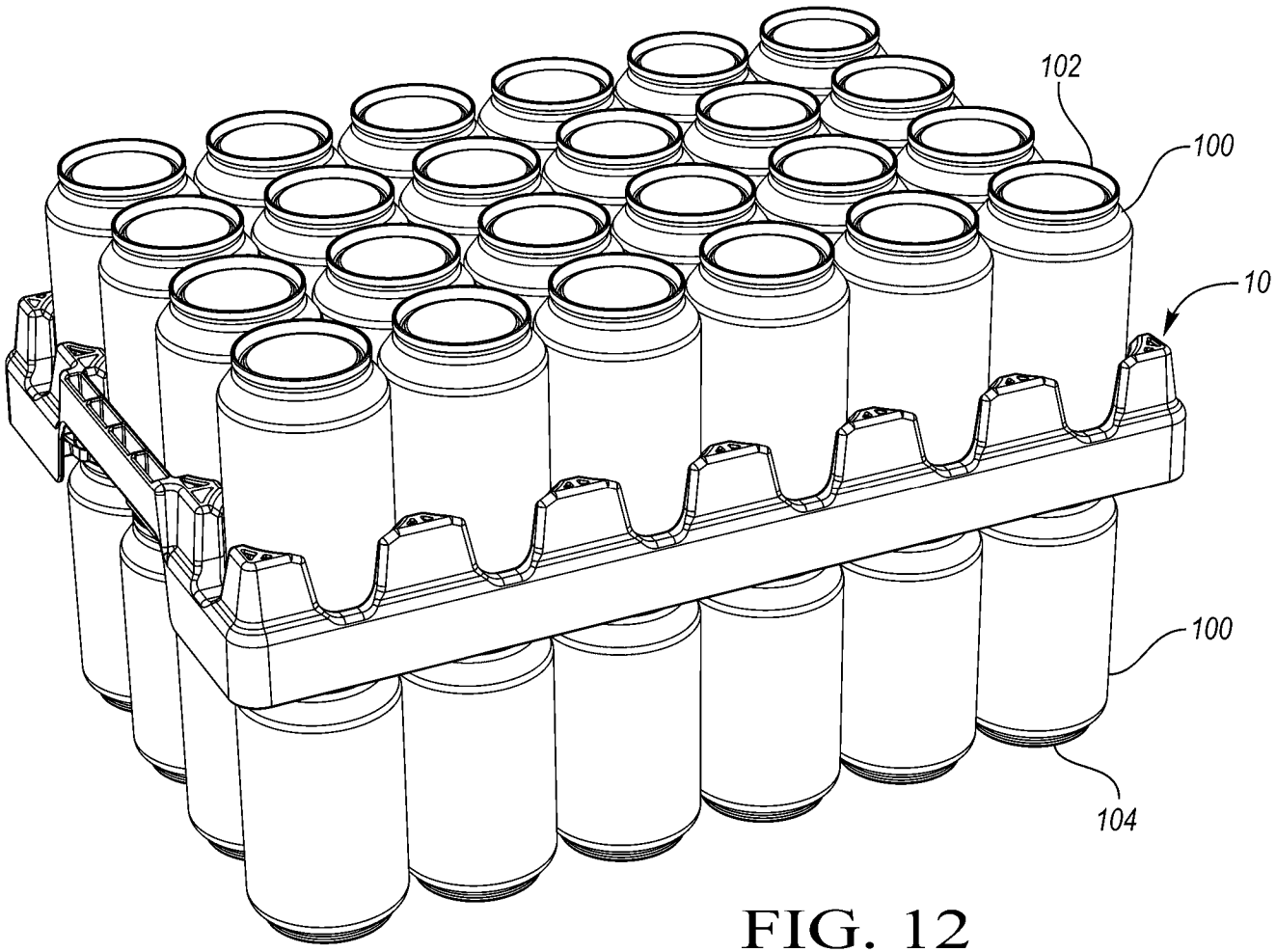
FIG. 12 shows the tray loaded with beverage cans and stacked on a plurality of beverage cans.

FIG. 12 shows the tray 10 full of cans 100, in this case, twenty-four cans in a tray 10. The tray 10 is also stacked on another twenty-four cans 100 (such as would be arranged on another tray 10 (not shown), aligned below tray 10.

Figure 13:
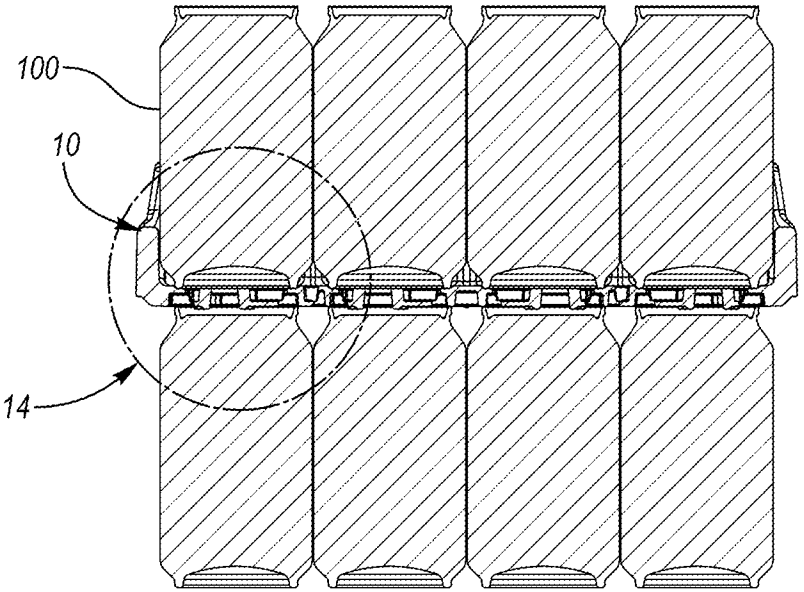
FIG. 13 is a section view through the tray and cans of FIG. 12.
Figure 14:
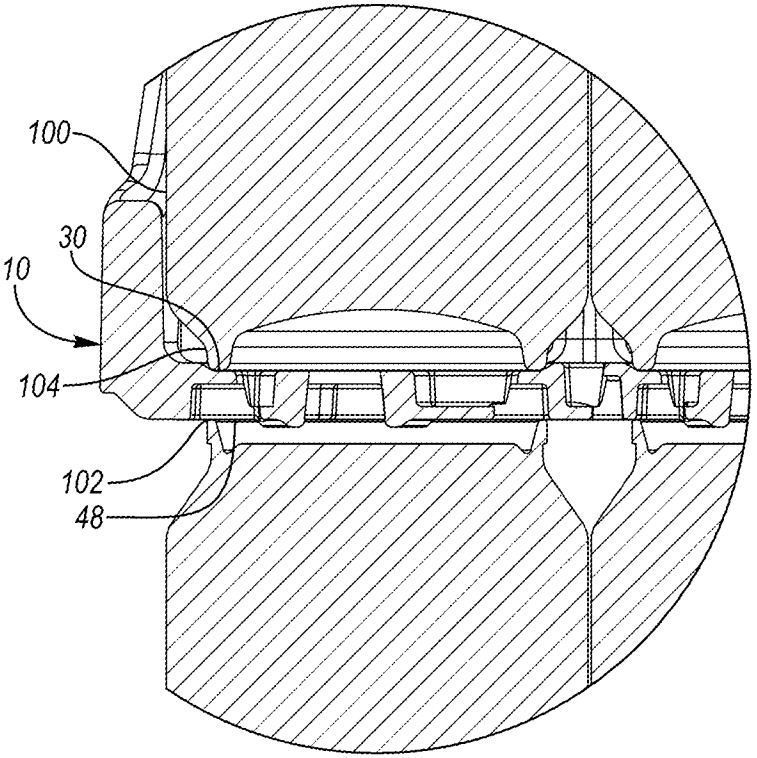
FIG. 14 is an enlarged view of area 14 of FIG. 13.

FIG. 13 is a section view through the cans 100 and tray 10 of FIG. 12. FIG. 14 is an enlarged area 14 of FIG. 13. As shown, increased contact area with the lower ring 104 and the upper ring 102 of the can is provided.

Figure 16:
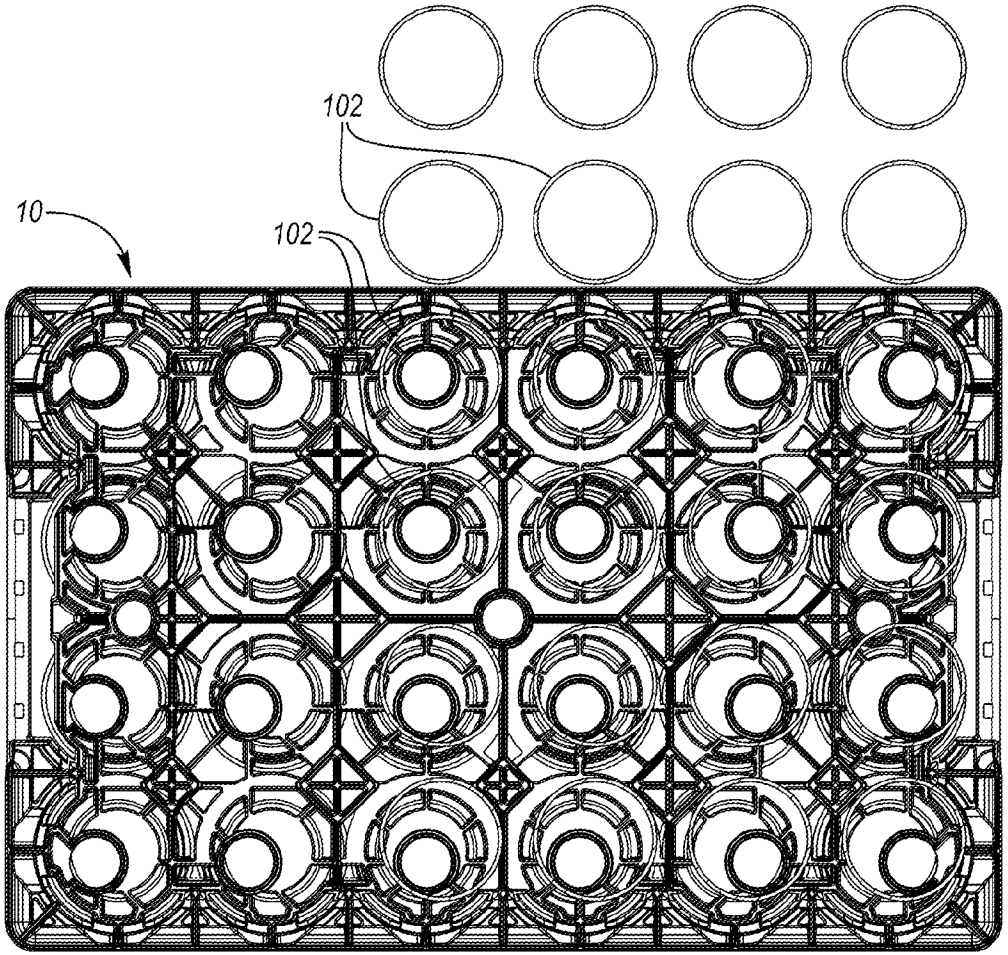
FIG. 16 is a section view taken along lines 16-16 of FIG. 15.
Figure 15:
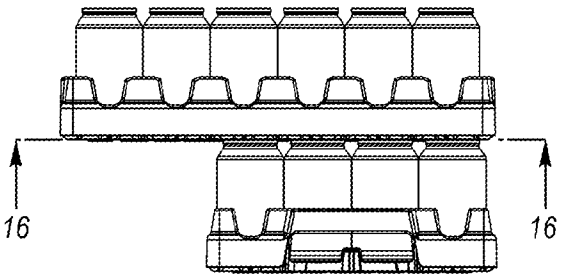
FIG. 15 is a side view of two of the trays loaded with cans and cross-stacked.

FIG. 15 is a side view of two cross-stacked trays 10 loaded with cans. FIG. 16 is a section view taken along line 16-16 of FIG. 15, to show the alignment of the upper rings 102 of the cans 100 with the ribs in the bottom of the upper tray 10. As shown in FIG. 16, even in a cross-stack configuration the upper rings 102 of the cans 100 in the lower tray 10 have significant contact with wall portions in the base 12 of the upper tray 10, including the horizontal wall portions in the base 12 of the upper tray 10. In this manner, the upper rings 102 of the cans 100 are protected.

Figure 18:
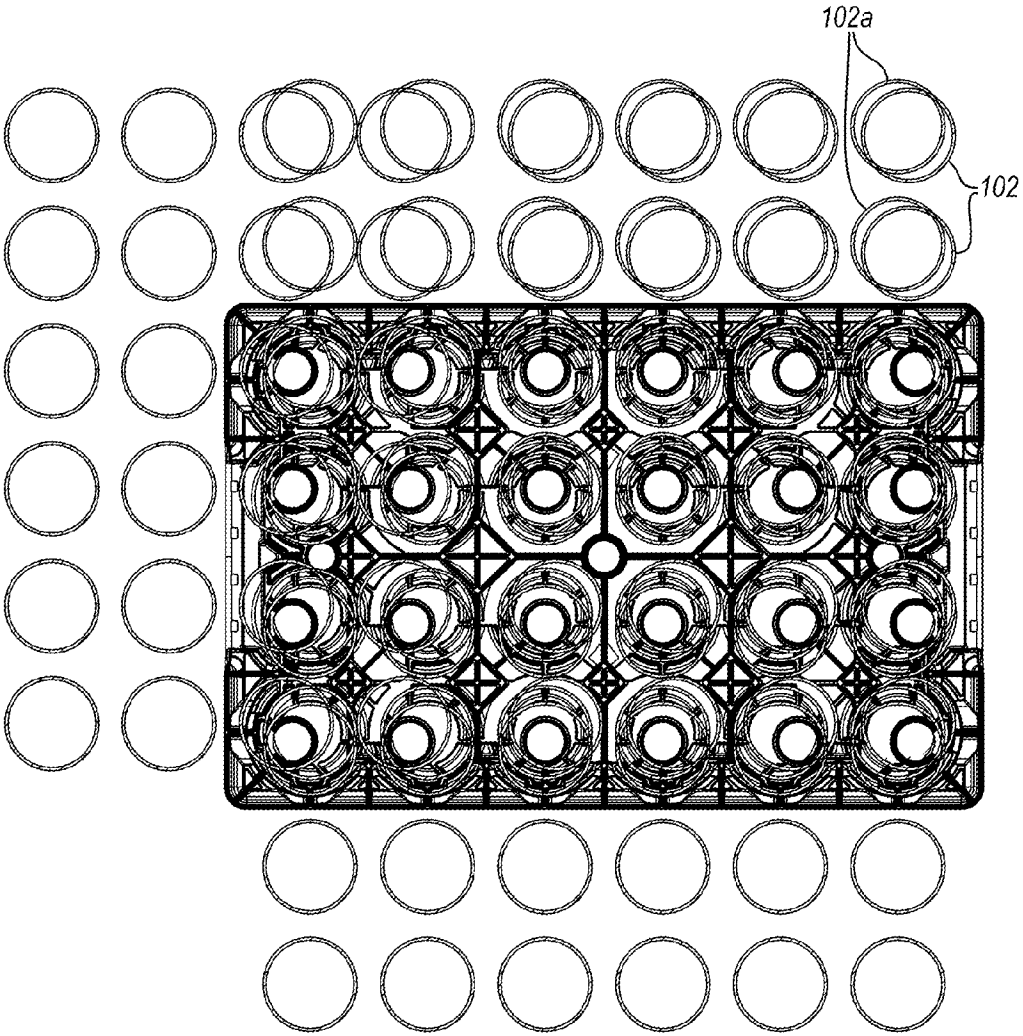
FIG. 18 is a section view taken along lines 18-18 of FIG. 17.
Figure 17:
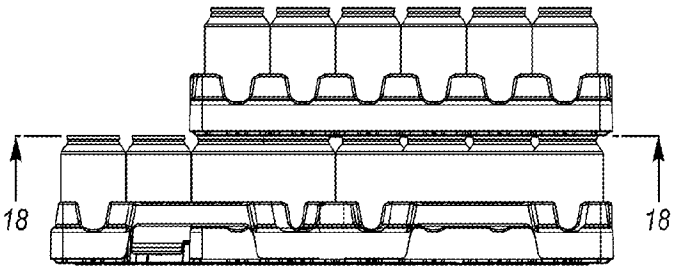
FIG. 17 is a side view of three of the trays loaded with cans and cross-stacked.

FIG. 17 is a side view of a tray 10 loaded with cans cross-stacked on two trays 10 loaded with cans. FIG. 18 is a section view taken along line 18-18 of FIG. 17. The alignment of the upper rings 102 of the cans 100 is shown, as is the alignment of the upper rings 102*a* of the cans 100 in a second orientation (stacked). As shown, the upper rings 102, 102*a* of the cans 100 in the lower tray 10 in either orientation have significant contact with wall portions in the base 12 of the upper tray 10, including the horizontal wall portions in the base 12 of the upper tray 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A nestable can tray comprising: a base including a plurality of intersecting vertical rib portions, a plurality of horizontal wall portions connected proximate lower ends of the vertical rib portions, a plurality of openings through the base between the plurality of intersecting vertical rib portions, a plurality of annular recesses formed on an upper surface of the base within upper ends of the vertical rib portions for receiving lower ends of beverage cans; side walls including side columns extending upward from lower side wall portions extending upward from sides of the base; and end walls including end columns at ends of the base; wherein the side columns are configured to be partially receivable into lower side wall portions of an identical tray nested thereon and wherein the end columns are configured to be partially receivable into end walls of the identical tray nested thereon.

2. The nestable can tray of claim 1 wherein the end walls each include a handle extending between two of the end columns.

3. The nestable can tray of claim 2 wherein the base does not extend below the handles.

4. The nestable can tray of claim 1 in combination with a plurality of beverage cans therein, each of the beverage cans including an upper ring and a lower ring, each lower ring received in one of the annular recesses in the base of the tray.

5. The nestable can tray of claim 1 in combination with a plurality of beverage cans therebelow, each of the beverage cans including an upper ring and a lower ring, each upper ring contacting at least one of the horizontal wall portions in the base of the tray.

6. The nestable can tray of claim 1 in combination with an identical lower can tray stacked therebelow and having a plurality of beverage cans loaded therein, each of the beverage cans including an upper ring and a lower ring, each upper ring contacting at least one of the horizontal wall portions in the base of the tray.

7. The nestable can tray of claim 6 wherein the tray and the identical lower can tray are cross-stacked.

8. The nestable can tray of claim 1 wherein outer-facing surfaces of the side columns are configured to be covered by the lower side wall portions of the identical tray nested thereon.

9. A nestable can tray comprising:

a base including a plurality of intersecting vertical rib portions, a plurality of horizontal wall portions connected proximate lower ends of the vertical rib portions, a plurality of openings through the base between the plurality of intersection intersecting vertical rib portions, a plurality of annular recesses formed on an upper surface of the base for receiving lower ends of beverage cans, wherein the plurality of vertical rib portions in the base includes a plurality of outer annular ribs each defining one of the annular recesses;

side walls including side columns extending upward from lower side wall portions extending upward from sides of the base; and end walls including end columns at ends of the base;

wherein the side columns are configured to be partially receivable into lower side wall portions of an identical tray nested thereon and wherein the end columns are configured to be partially receivable into end walls of the identical tray nested thereon.

10. The nestable can tray of claim 9 wherein the plurality of vertical rib portions in the base includes a plurality of inner annular ribs eccentrically positioned within each of the outer annular ribs.

11. The nestable can tray of claim 10 wherein the plurality of vertical rib portions in the base further includes a plurality of radial ribs connecting each inner annular rib to a corresponding one of the outer annular ribs.

12. The nestable can tray of claim 11 wherein the plurality of horizontal wall portions connect the plurality of inner annular ribs to the plurality of radial ribs.

13. The nestable can tray of claim 12 wherein the plurality of horizontal wall portions are recessed relative to lower ends of the plurality of vertical rib portions.

14. A nestable can tray comprising: a base including a plurality of intersecting vertical rib portions, a plurality of horizontal wall portions connected proximate lower ends of the vertical rib portions, wherein the horizontal wall portions are generally arcuate in a plane generally parallel to the base, a plurality of annular recesses formed on an upper surface of the base within upper ends of the vertical rib portions for receiving lower ends of beverage cans; side walls including side columns extending upward from lower side wall portions extending upward from sides of the base; and end walls including end columns at ends of the base; wherein outer-facing surfaces of the side columns are configured to be covered by the lower side wall portions of the identical tray nested thereon.

15. The nestable can tray of claim 14 wherein the end walls each include a handle extending between two of the end columns and wherein the base does not extend below the handles.

16. The nestable can tray of claim 14 further including a plurality of openings through the base between the plurality of intersecting vertical rib portions.

17. The nestable can tray of claim 14 in combination with a plurality of beverage cans therein, each of the beverage cans including an upper ring and a lower ring, each lower ring received in one of the annular recesses in the base of the tray.

18. The nestable can tray of claim 14 in combination with a plurality of beverage cans therebelow, each of the beverage cans including an upper ring and a lower ring, each upper ring contacting at least one of the horizontal wall portions in the base of the tray.

19. A nestable can tray comprising:

a base including a plurality of intersecting vertical rib portions, a plurality of horizontal wall portions connected proximate lower ends of the vertical rib portions, wherein the horizontal wall portions are generally arcuate in a plane generally parallel to the base, a plurality of annular recesses formed on an upper surface of the base for receiving lower ends of beverage cans, wherein the plurality of vertical rib portions in the base includes a plurality of outer annular ribs each defining one of the annular recesses and a plurality of inner annular ribs eccentrically positioned within each of the outer annular ribs, wherein the plurality of vertical rib portions in the base further includes a plurality of radial ribs connecting each inner annular rib to corresponding one of the outer annular ribs, wherein the plurality of horizontal wall portions connect the plurality of inner annular ribs to the plurality of radial ribs;

side walls including side columns extending upward from lower side wall portions extending upward from sides of the base; and end walls including end columns at ends of the base;

wherein outer-facing surfaces of the side columns are configured to be covered by the lower side wall portions of the identical tray nested thereon.

20. The nestable can tray of claim 19 wherein the plurality of horizontal wall portions are recessed relative to lower ends of the plurality of vertical rib portions.

* * * * *